US011389020B2

(12) United States Patent
Fortuna et al.

(10) Patent No.: US 11,389,020 B2
(45) Date of Patent: Jul. 19, 2022

(54) CONTAINER HOLDER AND METHODS RELATING TO SAME

(71) Applicant: JL Home Solutions, LLC, Greenwood, WI (US)

(72) Inventors: Jill P. Fortuna, Greenwood, WI (US); Louis A. Fortuna, Greenwood, WI (US)

(73) Assignee: JL Home Solutions, LLC, Greenwood, WI (US)

( * ) Notice: Subject to any disclaimer, the term of this patent is extended or adjusted under 35 U.S.C. 154(b) by 0 days.

(21) Appl. No.: 16/817,279

(22) Filed: Mar. 12, 2020

(65) Prior Publication Data

US 2020/0297139 A1 Sep. 24, 2020

Related U.S. Application Data

(60) Provisional application No. 62/821,861, filed on Mar. 21, 2019.

(51) Int. Cl.
*A47G 23/02* (2006.01)

(52) U.S. Cl.
CPC ..... *A47G 23/0241* (2013.01)

(58) Field of Classification Search
CPC . A47G 23/0241; B67D 3/0029; A47B 73/004
See application file for complete search history.

(56) References Cited

U.S. PATENT DOCUMENTS

| | | | | |
|---|---|---|---|---|
| 1,075,268 | A | 10/1913 | Oliphant | |
| 1,461,156 | A | 7/1923 | Martin | |
| 1,661,547 | A | 3/1928 | Reefer | |
| 2,483,166 | A | 9/1949 | Amberg | |
| 2,487,712 | A | 11/1949 | Johnson | |
| 2,610,492 | A | 9/1952 | Carew | |
| 2,678,146 | A | 5/1954 | Schleif | |
| 2,767,744 | A | 10/1956 | Beerman | |
| 2,785,551 | A | 3/1957 | Holzwarth | |
| D210,517 | S * | 3/1968 | Baratte | A47G 23/0241 D9/455 |
| 3,620,267 | A | 11/1971 | Seablom | |
| 3,877,499 | A | 4/1975 | Fluster | |
| 4,271,878 | A | 6/1981 | Bologa | |
| 4,328,942 | A * | 5/1982 | Birnbaum | F16M 13/00 248/146 |
| 4,454,897 | A | 6/1984 | Valiant | |
| 4,665,958 | A | 5/1987 | Holloway | |
| 5,080,150 | A | 1/1992 | Deadwyler, Jr. | |
| 5,105,860 | A | 4/1992 | Connor | |
| D332,551 | S | 1/1993 | Fields | |
| D335,625 | S | 5/1993 | Dolson | |
| 5,255,401 | A | 10/1993 | Sambrookes | |

(Continued)

*Primary Examiner* — Anita M King
(74) *Attorney, Agent, or Firm* — Fitch, Even, Tabin & Flannery, LLP

(57) ABSTRACT

A bottle holder comprising a first bottle holder portion having a diverging sidewall defining a first cavity for receiving at least a portion of a bottle, the first opening being open toward a first direction, and a second bottle holder portion having a second diverging sidewall having a different shape than the first diverging sidewall, the second diverging sidewall defining a second cavity for receiving at least a portion of a bottle, the second opening being open toward a second direction.

22 Claims, 10 Drawing Sheets

(56) References Cited

U.S. PATENT DOCUMENTS

| | | | | |
|---|---|---|---|---|
| 5,279,600 | A | 1/1994 | Hogan | |
| D360,114 | S | 7/1995 | Whiteside, Jr. | |
| 5,509,583 | A | 4/1996 | Dolson | |
| 5,634,573 | A | 6/1997 | Steinberg | |
| 5,664,753 | A | 9/1997 | Takei | |
| D386,084 | S | 11/1997 | Marseglia | |
| 5,702,009 | A | 12/1997 | Ouellet | |
| 5,755,418 | A | 5/1998 | Kracke | |
| 5,794,904 | A | 8/1998 | Hackley | |
| 5,950,698 | A | 9/1999 | Cristea | |
| 6,182,720 | B1 | 2/2001 | Barnoski | |
| 6,202,970 | B1 | 3/2001 | Dunbar | |
| 6,296,024 | B1 | 10/2001 | Oestreich | |
| 6,345,723 | B1 | 2/2002 | Blake | |
| RE37,566 | E | 3/2002 | Cristea | |
| 6,382,579 | B1 | 5/2002 | Kenniston | |
| 6,481,685 | B1 * | 11/2002 | Cormier | A47G 23/0241 248/309.1 |
| 6,502,711 | B1 | 1/2003 | Mc Rae | |
| 6,557,351 | B1 | 5/2003 | Ghedini | |
| D480,608 | S | 10/2003 | Haslam, Sr. | |
| 6,708,848 | B2 | 3/2004 | Sheridan | |
| D488,962 | S | 4/2004 | Catt | |
| 7,243,465 | B2 | 7/2007 | Donoho | |
| D565,845 | S * | 4/2008 | Paulsen | B67C 9/00 D4/113 |
| 7,415,996 | B2 * | 8/2008 | Favreau | A47G 23/0241 141/364 |
| 7,556,230 | B2 | 7/2009 | Sarullo | |
| 8,261,787 | B2 * | 9/2012 | Sanford | B67C 9/00 141/319 |
| D678,731 | S * | 3/2013 | O'Neill | F16M 13/00 D7/624.2 |
| 8,998,158 | B2 | 4/2015 | St Jacques | |
| 9,199,832 | B2 | 12/2015 | Fracasso | |
| 10,029,903 | B1 * | 7/2018 | White | B67C 11/02 |
| 2005/0040309 | A1 | 2/2005 | Paine | |
| 2007/0272329 | A1 * | 11/2007 | Favreau | A47G 23/0241 141/364 |
| 2011/0094991 | A1 | 4/2011 | Klein | |
| 2012/0306339 | A1 | 12/2012 | Lynch | |

* cited by examiner

CONTAINER HOLDER AND METHODS RELATING TO SAME

CROSS-REFERENCE TO RELATED APPLICATIONS

This application claims the benefit of U.S. Provisional Application No. 62/821,861, filed Mar. 21, 2019, and is hereby incorporated herein by reference in its entirety.

FIELD OF TECHNOLOGY

The present disclosure generally describes a bottle holder. More specifically, the present disclosure describes a device for holding a bottle in an inverted orientation and methods relating to same.

BACKGROUND

Bottles, such as shampoo bottles and condiment bottles, often have an elongated body with a broad base at a first end and a narrow neck and cap at a second, opposite end. The cap covers an opening in the neck through which the viscous material stored in the bottle is dispensed.

Bottles are stored upright with the first end facing downward and the second end facing upward. During storage, the viscous material settled towards the bottom of the internal cavity, near the second end of the bottle. When the bottle is inverted for use, the forces adhesion and cohesion counteract gravity to hold the material against the bottom and side surfaces of the internal cavity, making it difficult to get the last portion of material from the bottle.

The narrow cross section of the cap and neck of the bottles make balancing them in an inverted orientation difficult. When stored in the inverted orientation, the bottles are prone to falling over.

BRIEF DESCRIPTION OF THE DRAWINGS

Described herein are embodiments of systems, methods and apparatus for addressing these shortcomings.

This description includes drawings, wherein.

Figure 1A:
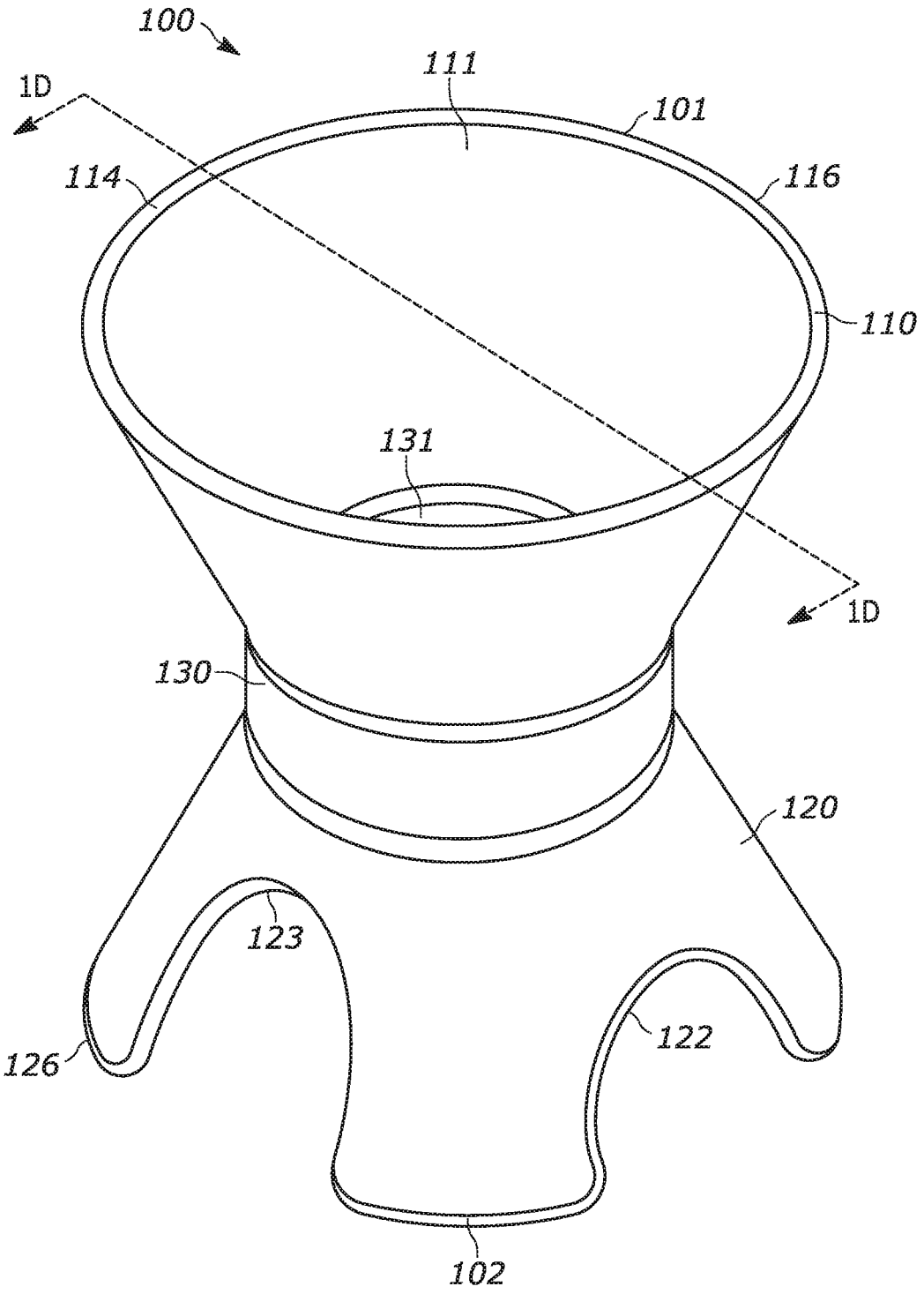
FIG. 1A is a perspective view of a bottle holder in a first orientation with a first end opening upward.

Corresponding reference characters in the attached drawings indicate corresponding components throughout the several views of the drawings. In addition, elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted or described in order to facilitate a less obstructed view of the illustrated elements and a more concise disclosure.

DETAILED DESCRIPTION

The present disclosure describes a bottle holder configured to hold a bottle in an inverted position with the cap of the bottle facing downward. The bottle holder has cavities opening toward opposite ends thereof. The cavities are different shapes and/or sizes, such that the bottle holder can be inverted to hold different shaped or sized bottles.

Certain embodiments also have a central, annular portion sized to fit around a standard sized bottle cap or bottle neck. The annular portion is configured to hold bottles that extend through one of the two cavities.

FIGS. 1A-1D represent exemplary embodiments of an invertible bottle holder 100. In some examples, the invertible bottle holder 100 has first holder portion 110, a second holder portion 120, and a central portion 130. The first holder portion 110 has a sidewall 116 which defines a first cavity 111 opening at a first end 101 of the invertible bottle holder 100. The first and second holder portions 110, 120 have diverging shapes, such that they are wider at the distal ends and narrower near the central portion 130. The first cavity 111 has a triangular or frustoconical shape. The frustoconical shape of the first cavity 111 is configured to receive bottles having a substantially circular cross-section. The slope of the frustoconical first cavity 111 is configured to receive bottles of differing diameters by inserting them into the first cavity until the outer surface of the bottle contacts the inner surface 114 of the first holder portion 111.

Figure 1B:
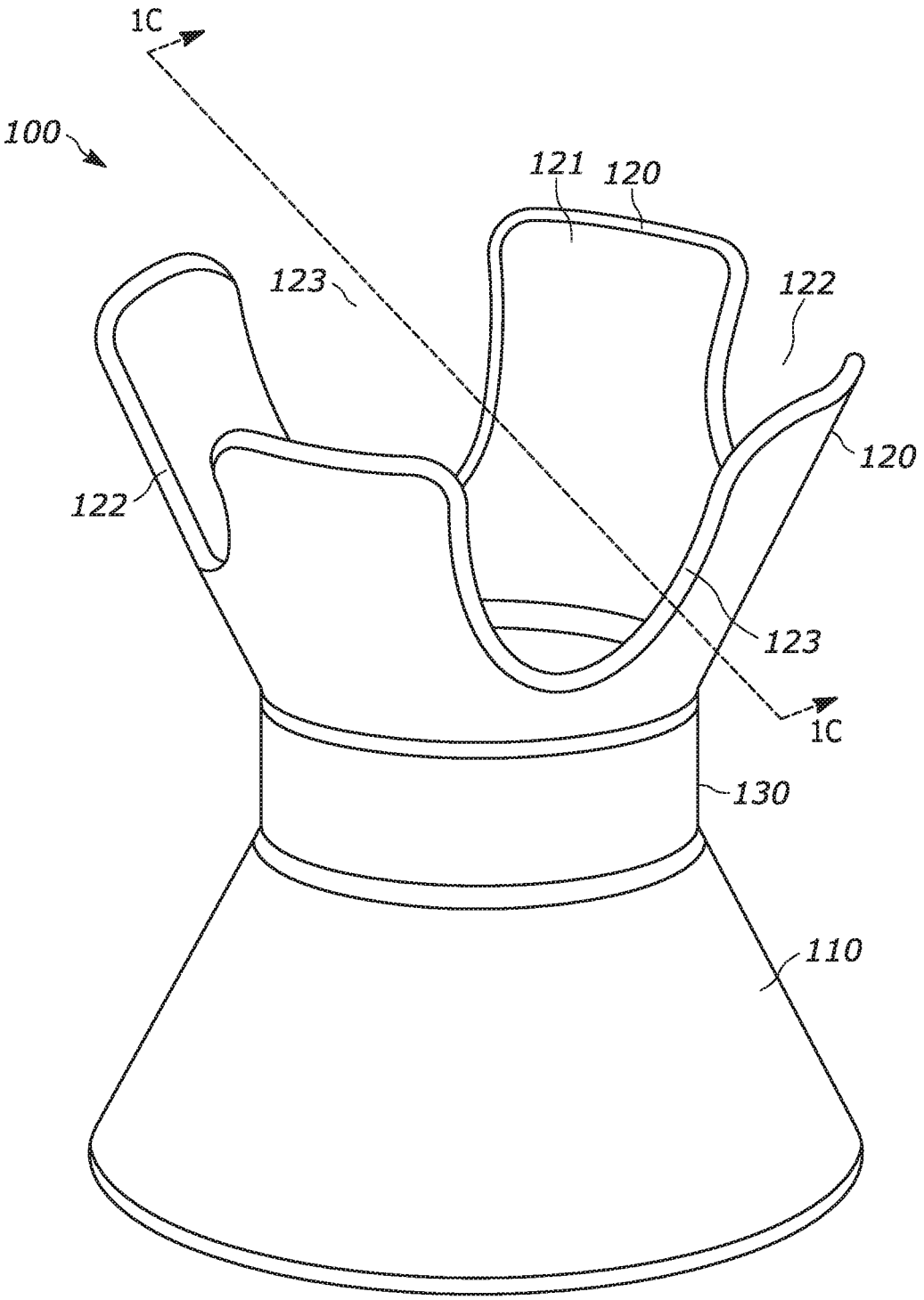
FIG. 1B is a perspective view of the bottle holder of FIG. 1A in a second orientation with the first end opening downward.
Figure 1C:
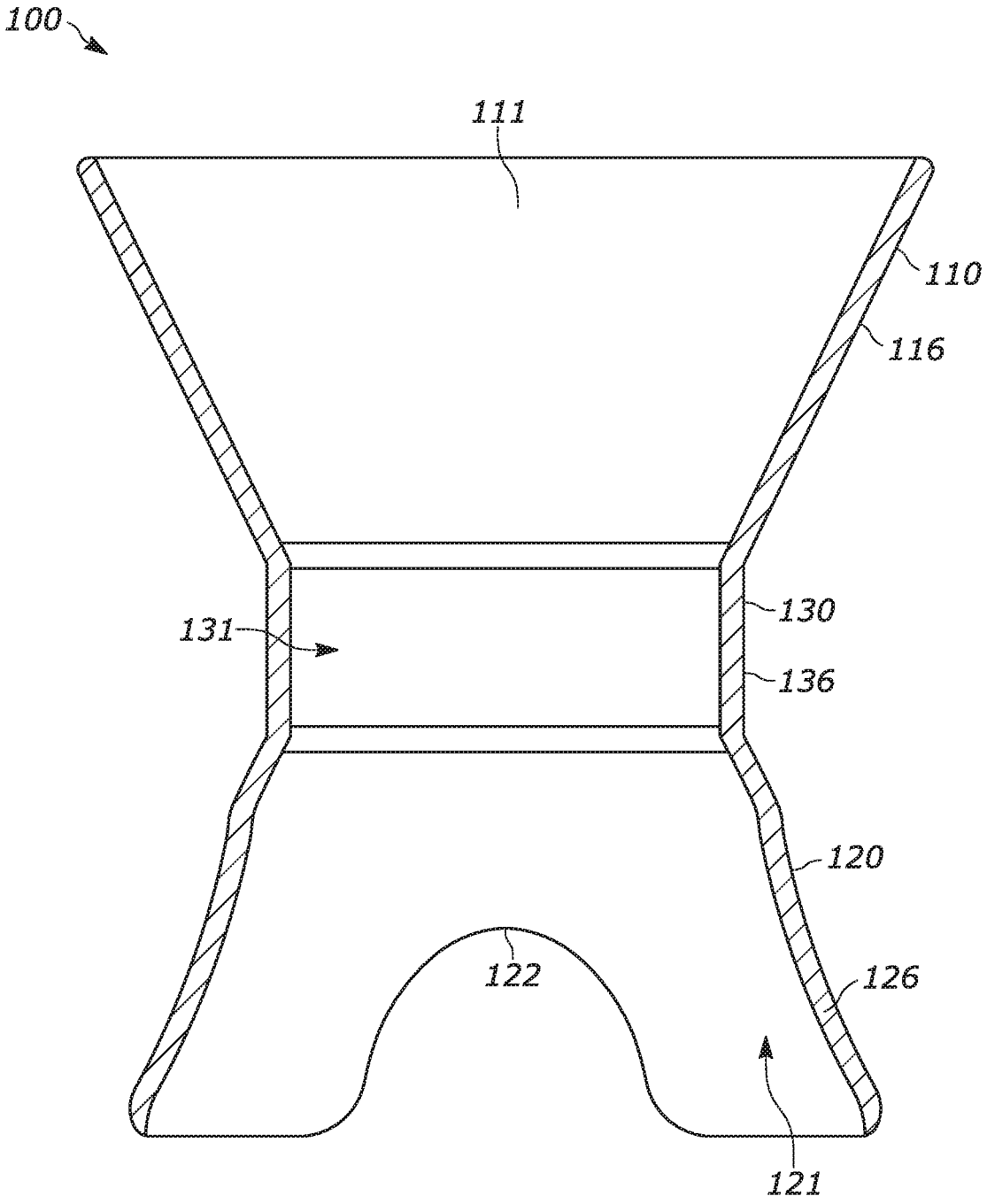
FIG. 1C is a cross-sectional view of the bottle holder of FIGS. 1A-1B taken along line 1C-1C.
Figure 1D:
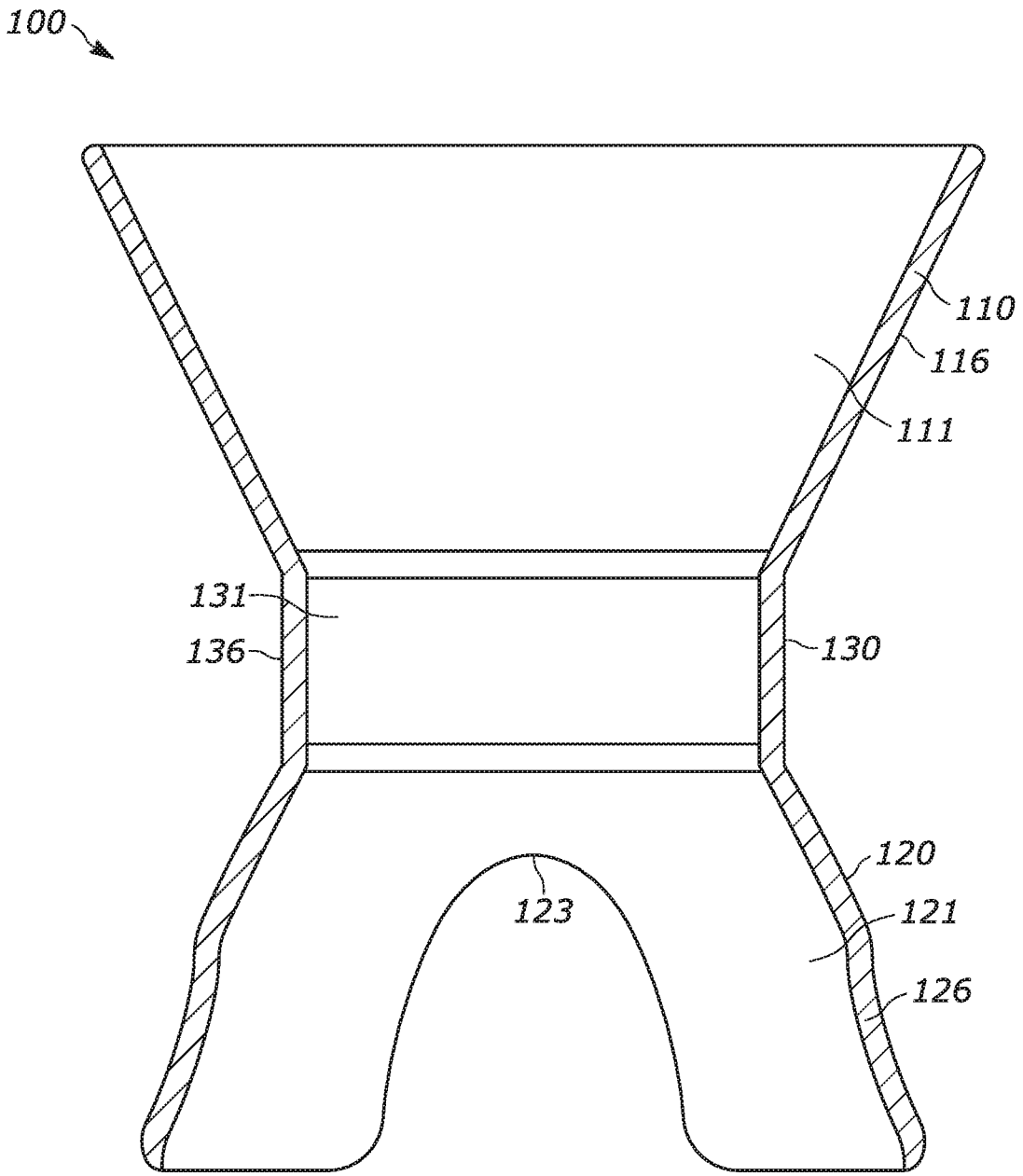
FIG. 1D is a cross-sectional view of the bottle holder of FIGS. 1A-1C taken along line 1D-1D.

The second holder portion 120 has a sidewall 126 which defines a second cavity 121 opening at a second end 102 of the invertible bottle holder 100. The second end 102 is opposite the first end 101, such that when the first end 101 is oriented upward, as shown in FIG. 1A, the second end 102 is oriented downward. A first pair of cutouts or apertures 122 extend through the sidewall 126 and are spaced opposite each other. A second pair of cutouts or apertures 123 extend through the sidewall 126 and are spaced opposite each other. The second pair of apertures 123 are spaced circumferentially from the first pair of apertures 122 by approximately 90 degrees. The second pair of apertures 123 are a different size and/or shape than the first set of apertures. Each aperture 122/123 is open at the second end 102 of the invertible bottle holder 100, such that when the invertible bottle holder 100 is in the second orientation, as shown in FIG. 1B, a portion of a bottle can be received in an aperture 122/123 from above.

Figure 2A:
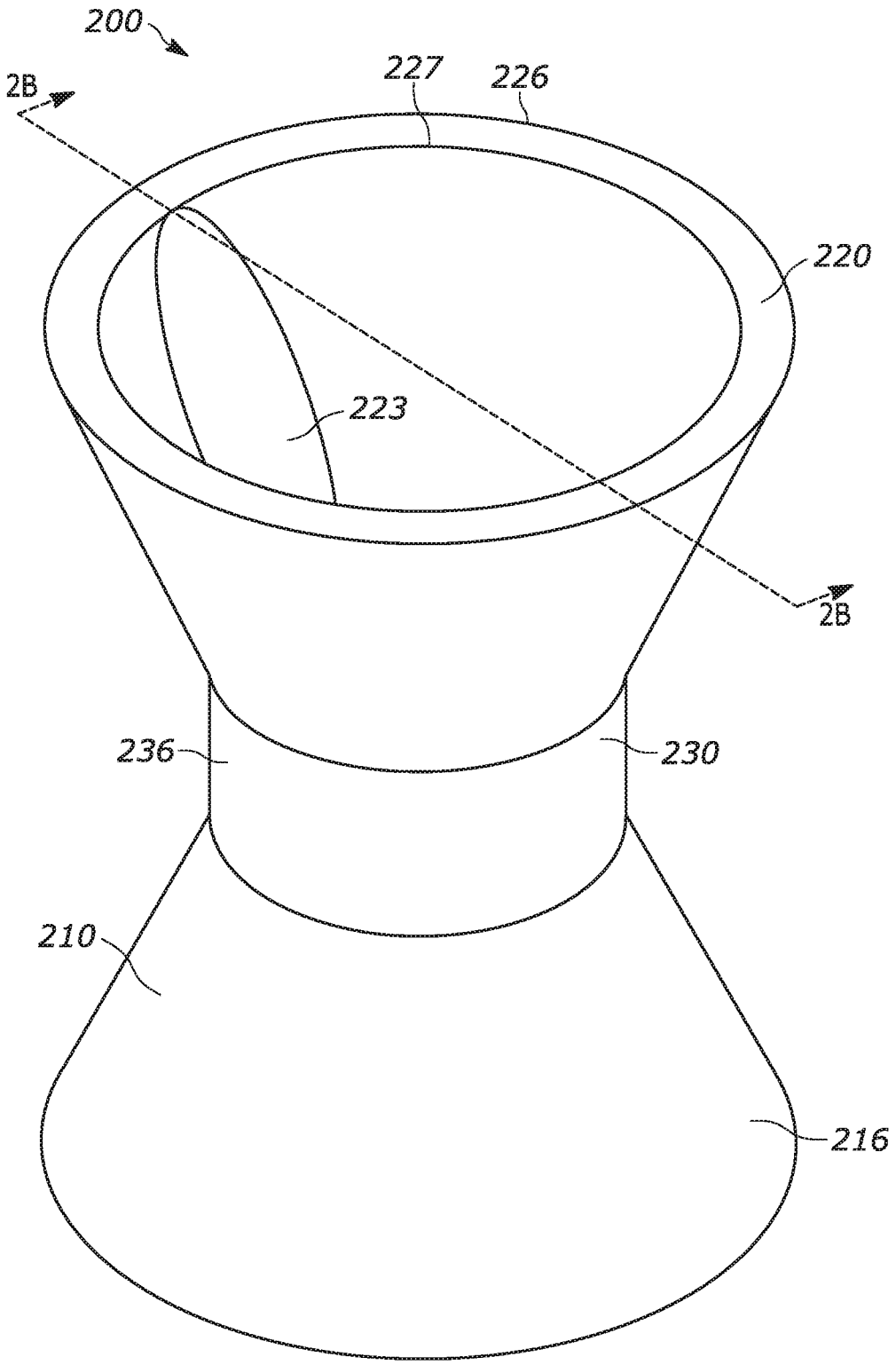
FIG. 2A is a perspective view of a bottle holder in a first orientation with a first end opening upward.
Figure 2B:
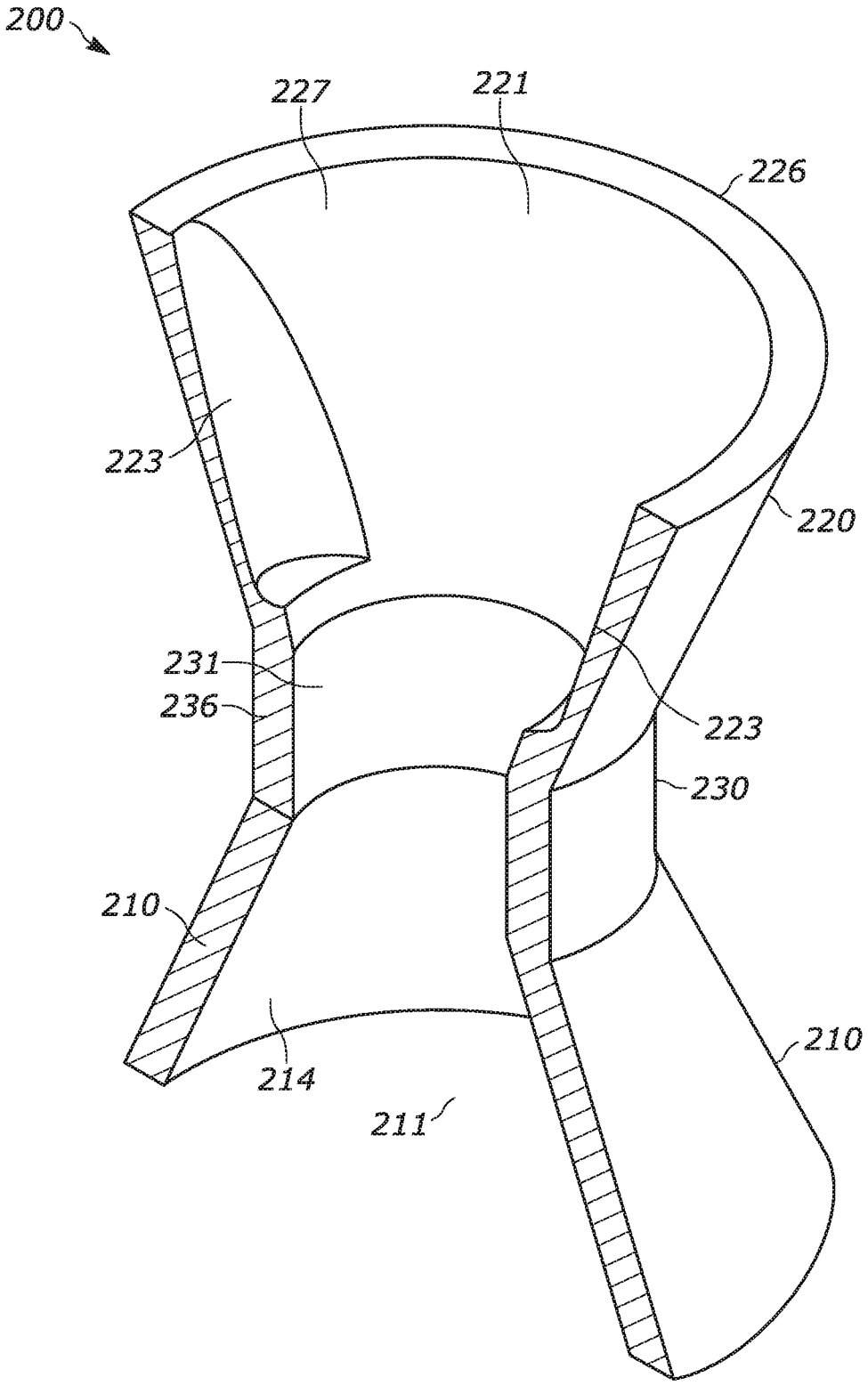
FIG. 2B is a cross-sectional view of the bottle holder of FIG. 2A taken along the line 2B-2B.

The second holder portion 120 is configured to support a bottle having a cross-section which is longer in a first direction than it is in a second, perpendicular direction. For example, and bottle having an ovular or elliptical cross-section. The long axis of the bottle's cross-section is aligned with a pair of cavities or apertures 122/123 such that a portion of the bottle is received in the apertures 122/123. The sidewall proximate the apertures 122/123 extend about a portion of the bottle, to support to bottle in a vertical orientation. In alternative forms, the second holder portion includes recesses or cavities for supporting bottles having an elongated cross-section. FIGS. 2A-2B, discussed below, illustrate an invertible bottle holder 200 wherein the second holder portion 220 has a frustoconical sidewall 226 having a pair of recesses 222 in the internal surface of the sidewall 226. In still further alternatives, as shown in FIGS. 3A-3D and discussed below, inserts 340 are inserted into the second holder portion 320. The inserts 340 have an inner cavity 323 with an elongated cross-section corresponding to the cross-section shape of one or more bottles.

The central portion 130 has a substantially annular sidewall 136. The sidewall 136 defines a substantially cylindrical internal cavity 131. The central portion 130 is sized to receive a cap or neck of a bottle. The sidewall 136 fits tightly around the perimeter of the cap or neck, so as to secure the bottle in an upright position. A bottle being supported in this manner is illustrated in FIG. 3B.

In some forms the central portion 130 has a stepped cross-section such that the sidewall 136 defines multiple cylindrical cavities of differing diameters. As such, the central portion 130 is configured to support bottles with differing sized caps or necks.

FIGS. 2A-2B illustrate an invertible bottle holder 200. The invertible bottle holder 200 has a first holder portion 210 a second holder portion 220, and a central portion 230. The first holder portion 210 and central portion 230 are substantially similar to the first holder portion 110 and central portion 130 described above.

The second holder portion 220 has a frustoconical sidewall 226 defining an inner cavity 221 into which a portion of a bottle is received. The sidewall 226 has an inner surface 227 into which two opposing cavities 223 are disposed. The cavities 223 are configured to receive a portion of a noncylindrical bottle. In operation, a noncylindrical bottle, such as a bottle having an elliptical cross section, is inserted into the bottle holder 200 with the major axis of the bottle's cross section aligning with the cavities 223. The portion of the sidewall 226 defining the cavities 223 contact the sidewall of the bottle to support the bottle in an inverted orientation.

The first holder portion 210 includes a frustoconical sidewall 216 having a substantially smooth inner surface 214. The sidewall 216 defines an inner cavity 211 configured to receive a portion of an inverted bottle. In operation, the sidewalls 216 contacts the inverted bottle so as to support the bottle in the inverted position.

The bottle holder 200 is invertible between a first position, in which the first holder portion 210 opens upward, and a second position, in which the second holder portion 220 opens upward. In the first position, the second holder portion 220 serves as a base, resting on a flat surface, such as a shelf. The first holder portion 210 receives the top portion of an inverted bottle and supports the bottle in a vertical orientation so that fluid within the bottle settles toward the cap of the bottle. Similarly, with the bottle holder 200 in the second position, the first holder portion 210 serves as a base and the second holder portion 220 receives an inverted bottle and supports it in the vertical orientation.

The central portion 230 of the bottle holder includes an annular sidewall 236 defining a cylindrical interior space 231. The interior space 231 is sized to receive the cap or neck of a bottle having an elongated neck. The sidewall 236 frictionally engages the cap or neck so as to support the bottle in an inverted orientation. In some forms, the sidewall 236 has a stepped cross section so as to define multiple cylindrical interior space 231 having different diameters.

In some alternatives, the bottle holder includes removable inserts having cavities for supporting different shaped bottles. FIGS. 3A-3D illustrate a bottle holder 300 having a first bottle holding portion 310, second bottle holding portion 320, and central portion 330. An insert 340 is inserted into the second bottle holding portion 320.

The first and second bottle holder portions 310, 320 have frustoconical sidewalls 316, 326 defining internal cavities 311, 321 as described in the embodiments above. The insert 340 is a removable insert which detachably couples to one of the sidewalls 316, 326. In some forms, the insert 340 forms a friction fit with the inner surface of the sidewall 316, 326.

The insert 340 has a sidewall 346 defining an inner cavity 341. As shown, the inner cavity 341 has a generally elliptical cross section. In operation, the insert 340 is oriented to open upward, and an inverted bottle having a generally elliptical cross section is at least partially inserted into the cavity 341. The sidewall 346 contacts the sidewall of the bottle so as to support the bottle in the inverted orientation.

While the insert 340 has an elliptical cross section, it is understood that inserts having differently shaped cavities are considered for supporting differently shaped bottles. For example, inserts 340 having cavities 341 with ovular, oblong, pill-shaped, or rectangular cross sections are considered.

Figure 4A:
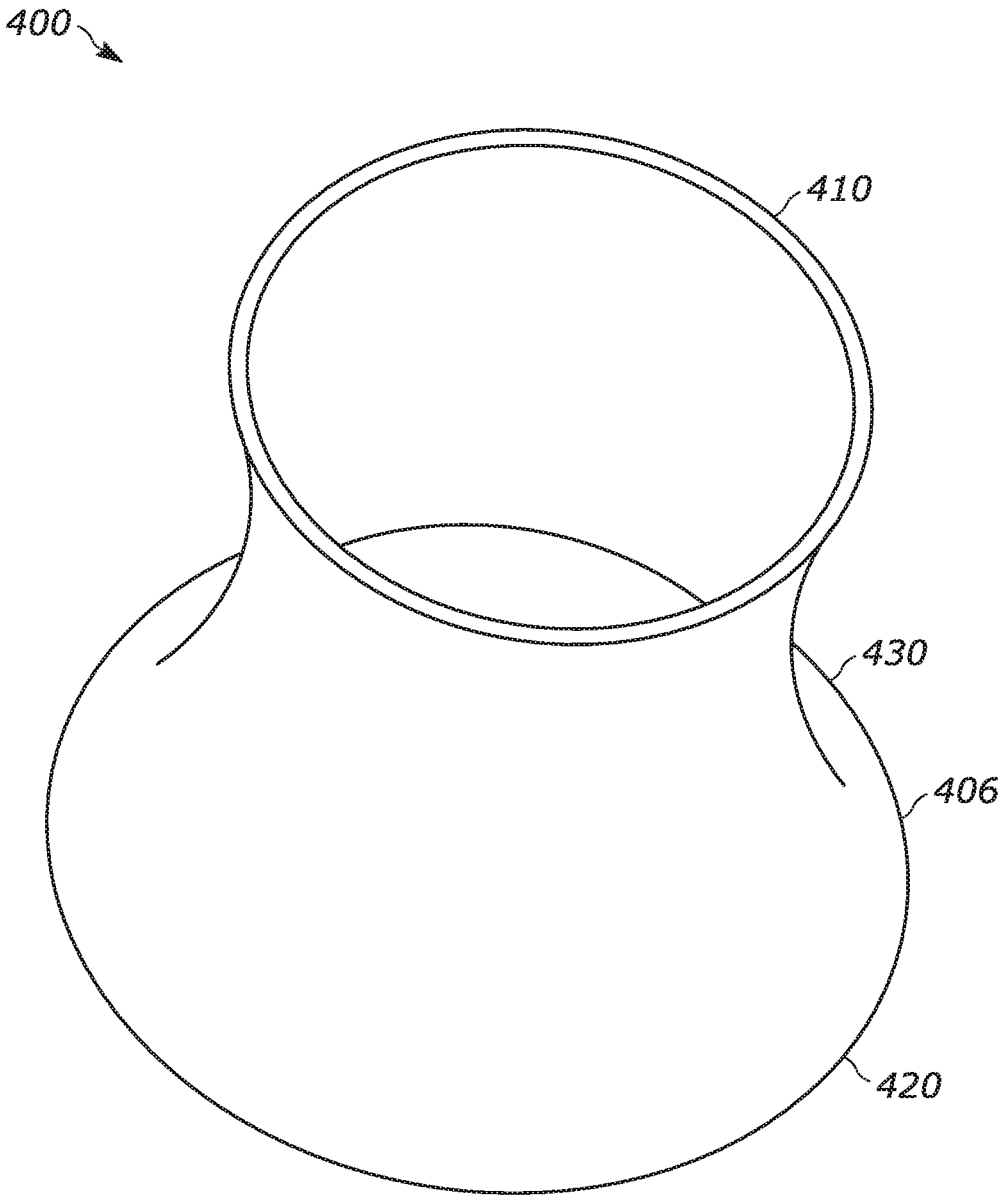
FIG. 4A is a perspective view of a hyperboloid bottle holder.
Figure 4B:
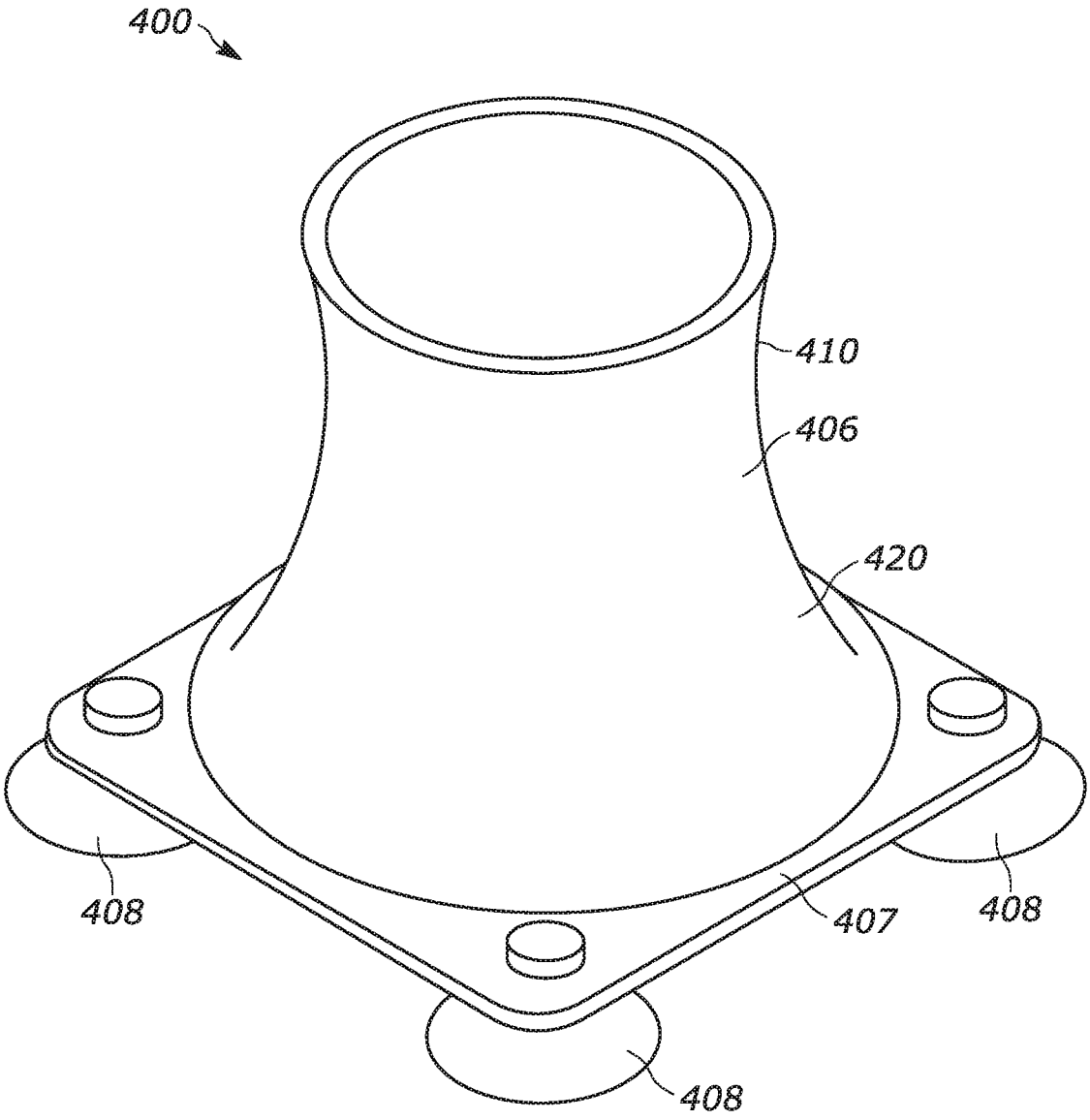
FIG. 4B is a perspective view of the bottle holder of FIG. 4A with a bottom flange.

In some forms, the diverging bottle holder portions of an invertible bottle holder diverge at a nonlinear rate relative to the distance from the central portion. For example, as shown in FIGS. 4A-4B, a bottle holder 400 has a sidewall 406 having a hyperboloid shape. The hyperboloid shaped sidewall narrows at a central portion 430 and flares outward towards both ends to form a first bottle holder portion 410 and second bottle holder portion 420. The second bottle holder portion 420 has a wider cross section at its distal end than the first bottle holder portion. The differently sized bottle holder portion 410, 420 are configured to support different sized bottles in inverted orientations.

In some forms, the bottle holder 400 includes attachment structure for detachably coupling the bottle holder to a supporting surface, such as a shelf. The bottle holder 400 has a flange portion 407 to which a plurality of suction cups 408 are coupled. The suction cups 408 are used to couple the bottle holder 400 to a flat surface. In some forms, the bottle holder 400 includes a second flange portion 407 with a second attachment structure 408 on the opposite end for coupling the bottle holder 400 to a flat surface when in the inverted orientation. In alternative embodiments, other attachment structures 408 are used, such as magnets, high friction materials, or sticky materials.

Figure 3A:
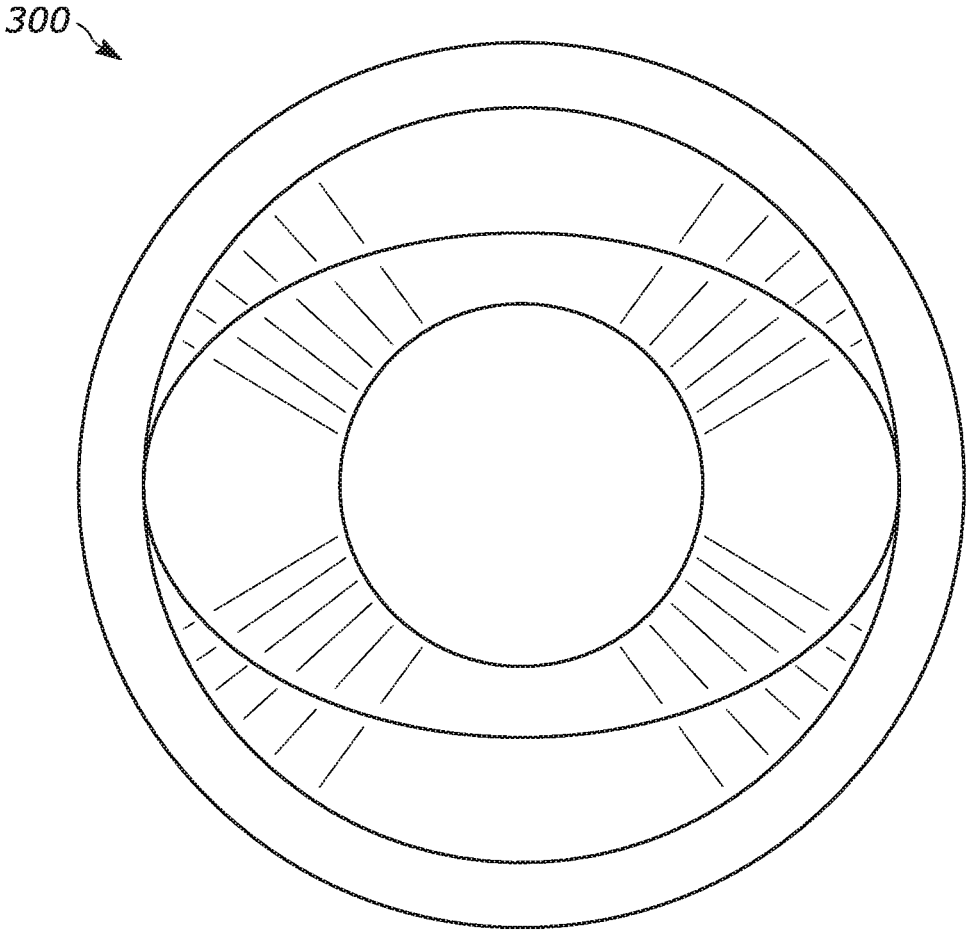
FIG. 3A is a top plan view of a bottle holder having an insert.
Figure 3D:
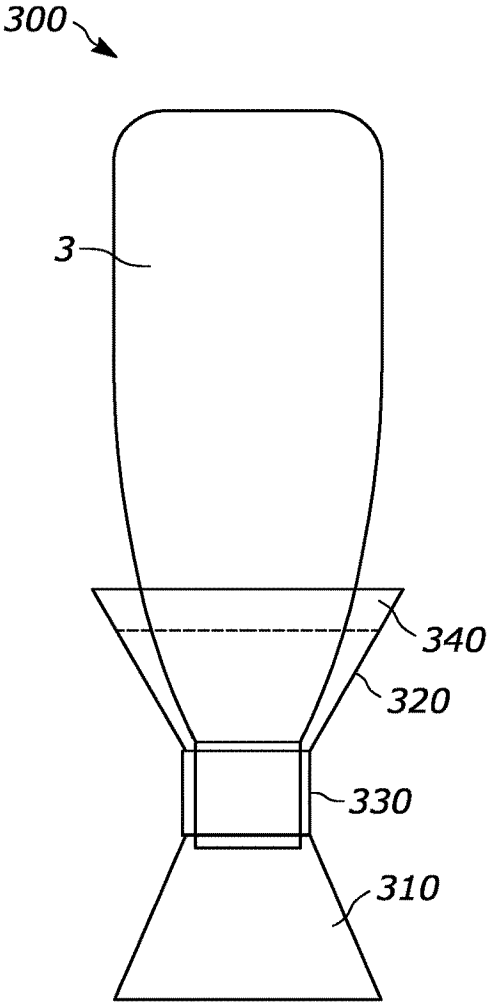
FIG. 3D is a front elevation view of the bottle holder of FIGS. 3A-3C holding a noncylindrical bottle.
Figure 3C:
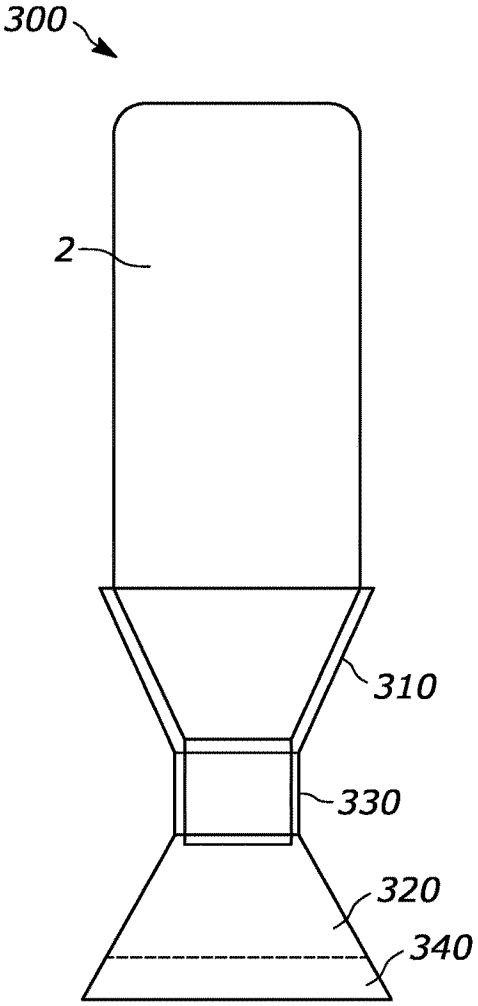
FIG. 3C is a front elevation view of the bottle holder of FIGS. 3A-3B holding a cylindrical bottle.
Figure 3B:
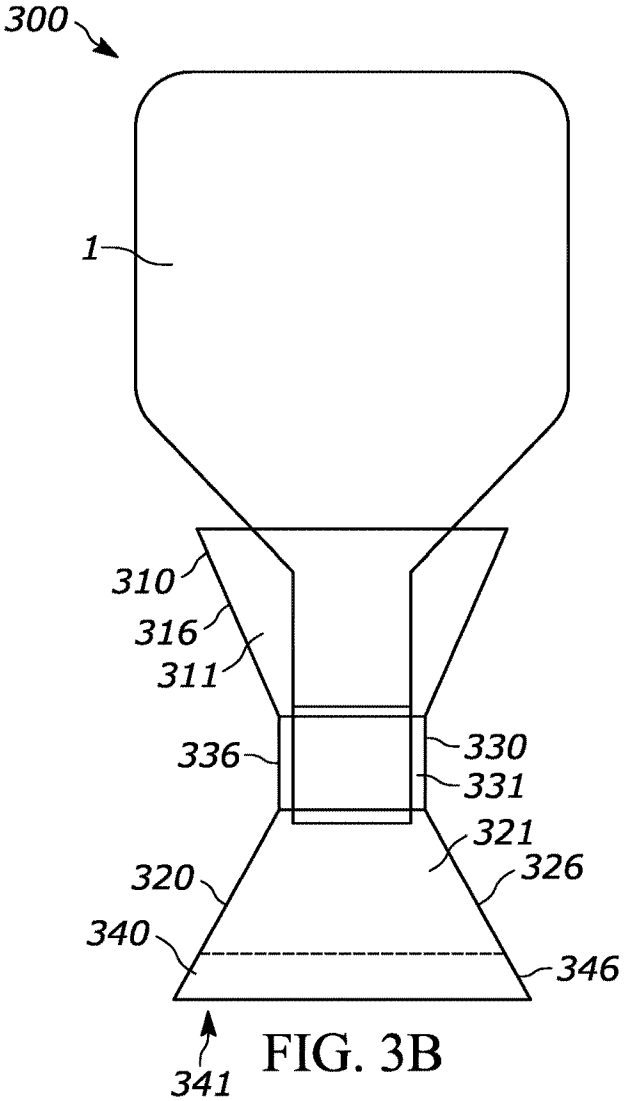
FIG. 3B is a front elevation view of the bottle holder of FIG. 3A holding a long neck bottle.

FIGS. 3B-3D illustrate the bottle holder 300 being used to support three different shaped bottles 1, 2, 3 in inverted orientations. The bottle holders 100, 200, 400 can be similarly used to support these same bottles 1, 2, 3 in the respective orientations.

FIG. 3B illustrates the bottle holder 300 supporting a bottle 1 having an elongated neck. The neck extends through the first holder portion 310 without contacting the sidewall 316. The cap extends into the cavity 331 defined by the central portion 330, and frictionally engages the sidewall 336 thereof. The frictional engagement between the sidewall 336 and the cap of the bottle 1 supports the bottle in the orientation shown.

FIG. 3C illustrates the bottle holder 300 supporting a bottle 2 having a substantially cylindrical main body. As shown, the cylindrical main body has a frustoconical top portion narrowing to a cap. The top portion of the bottle 2 is received within the cavity 311 of the top holder portion 310 of the bottle holder 300. The inner surface 314 of the sidewall 316 contacts the sidewall of the bottle 2 so as to support the bottle 2.

FIG. 3D illustrates the bottle holder 300 in a second, inverted orientation compared to the orientation shown in FIGS. 3B-3C. The insert 340 is inserted into the second bottle holder portion 320. A bottle having a substantially elliptical cross section is inserted into the insert 340. The sidewall 346 of the insert 340 supports the bottle in the inverted position shown.

In each of the operations shown in FIGS. 3B-3D, the downward facing bottle holder portion 310, 320 provides a relatively wide base, such that the bottle holder 300 and bottle 1, 2, 3 assembly is stable. Gravity acts on the fluid within the bottle 1, 2, 3, causing the fluid to settle near the cap of the bottles 1, 2, 3.

In one exemplary embodiment, a container holder 100, 200, 300, 400 is provided comprising a base 120, 220, 320, 420 for supporting a receptacle and a receptacle 110, 210, 310, 410 positioned atop the base for holding a container in an inverted orientation, the receptacle tapering from a larger opening on an end positioned opposite the base to a smaller opening on an end positioned proximate the base.

In some forms the base and receptacle form a substantially dual cone structure with the base 120, 220, 320 forming an inverted cone and the receptacle forming an unturned cone 110, 210, 310. In further embodiments, the inverted cone and unturned cone meet at a cylindrical collar 130, 230, 330 positioned between the cones.

In some operations of the container holder, the container is a long neck bottle and the cylindrical collar has a diameter sized to frictionally fit an opening of the long neck bottle when the long neck bottle is positioned on the container holder in an inverted orientation. In some forms, the container is a long neck bottle and the collar defines an internal step having an upper surface that may be used to support the opening of the long neck bottle when the long neck bottle is positioned on the container holder in an inverted orientation.

In other operations of the container holder, the container is an oval shaped bottle and the unturned cone defines recesses for receiving shoulder portions of the oval shaped bottle when the oval bottle is positioned on the container holder in an inverted orientation.

In some embodiments, recesses 123, 223 are defined in opposing sides of the unturned cone 120, 220. In some forms, the recesses 123 comprise openings entirely through a side wall of the unturned cone. For example, the openings entirely through the side walls of the unturned core comprise a first pair 123 of openings through opposite sides of the side wall of the unturned cone and a second pair 122 of openings through opposite sides of the side wall of the unturned cone, wherein the second pair of openings are rotated ninety degrees along the side wall from the first pair of openings so that axes extending between the respective opening pairs would intersect and be perpendicular to one another. In some forms, the first pair of openings and second pair of openings have opening shapes that differ from one another so that the first pair of openings can accommodate containers different than the second pair of openings and vice versa.

In some embodiments, the container holder is reversible and the cone of the inverted cone differs in size from the cone of the unturned cone so that the container holder may be used in a first orientation to support bottles of a first type and may be used in a second orientation to support bottles of a second type different from the first type.

In other embodiments, the substantially dual cone structure is a substantially hyperboloid structure with an upward opening first portion 410 defining the receptacle and unturned cone and a downward opening second portion 420 defining the base and inverted cone.

In some forms, the first and second portions intersect with one another on respective first ends and terminate in respective upward and downward facing openings at distal ends thereof, and wherein the second portion is larger than the first portion and has four substantially triangular flanges extending from quadrants of the distal end defining the downward facing opening with each substantially triangular flange defining an opening and having a respective suction member disposed partially within each opening to allow the container holder to be suctioned to a surface to hold the container holder in place with respect to the surface.

It should be understood that the embodiments discussed herein are simply meant as representative examples of how the concepts disclosed herein may be utilized and that other system/method/apparatus are contemplated beyond those few examples. In addition, it should also be understood that features of one embodiment may be combined with features of other embodiments to provide yet other embodiments as desired, for example, the hyperboloid bottle holder 400 may include recesses 123 or 223, or the a bottle holder with frustoconical sidewalls may include a flange with attachment structures.

What is claimed is:

1. A bottle holder comprising:

a first bottle holder portion having a first diverging sidewall defining a first cavity for receiving at least a portion of a bottle, the first cavity being open toward a first direction; and a second bottle holder portion unitarily formed as a single piece with the first bottle holder portion and having a second diverging sidewall having a different shape than the first diverging sidewall, the second diverging sidewall defining a second cavity for receiving at least a portion of a bottle and the second diverging sidewall including a first recess and a second recess positioned on opposite sides of the second cavity relative to each other, the second cavity being open toward a second direction;

wherein the first and second diverging sidewalls together are hyperboloid shaped.

2. The bottle holder of claim 1 further comprising a central portion having an annular sidewall, the central portion being between the first bottle holder portion and the second bottle holder portion, the first cavity being connected to the second cavity via the central portion, wherein the central portion receives at least a portion of a dispensing end of the bottle when the bottle is received within the first bottle holder portion or the second bottle holder portion.

3. The bottle holder of claim 2 wherein the first and second diverging sidewalls diverge toward the central portion.

4. The bottle holder of claim 1 wherein the first diverging sidewall is frustoconical shaped.

5. The bottle holder of claim 1 wherein the second diverging sidewall is frustoconical shaped.

6. The bottle holder of claim 1 wherein the first and second recesses extend through the second diverging sidewall.

7. The bottle holder of claim 1 further comprising an insert configured to be received in at least one of the first and second cavities, the insert having a third sidewall defining a third cavity for receiving at least a portion of a bottle.

8. The bottle holder of claim 1 further comprising a flange coupled to a distal end of one of the first diverging sidewall and the second diverging sidewall.

9. A bottle holder comprising:

a first bottle holder portion having a first diverging sidewall defining a first cavity for receiving at least a portion of a bottle, the first cavity being open toward a first direction;

a second bottle holder portion unitarily formed as a single piece with the first bottle holder portion and having a second diverging sidewall having a different shape than the first diverging sidewall, the second diverging sidewall defining a second cavity for receiving at least a portion of a bottle and the second diverging sidewall including a first recess and a second recess positioned on opposite sides of the second cavity relative to each other, the second cavity being open toward a second direction; and at least one attachment structure coupled to a flange coupled to a distal end of one of the first and second diverging sidewalls.

10. The bottle holder of claim 9 wherein the at least one attachment structure comprises a suction cup.

11. A container holder comprising:

a base for supporting a receptacle;

a receptacle unitarily formed as a single piece with the base and atop the base for holding a container in an inverted orientation, the receptacle tapering from a larger opening on an end positioned opposite the base to a smaller opening on an end positioned proximate the base, the receptacle including recesses for supporting the container in the inverted orientation, wherein the base and receptacle form a substantially dual cone structure with the base forming an inverted cone and the receptacle forming an unturned cone.

12. The container holder of claim 11 wherein the substantially dual cone structure is a substantially hyperboloid structure with an upward opening first portion defining the receptacle and unturned cone and a downward opening second portion defining the base and inverted cone.

13. The container holder of claim 11 wherein the inverted cone and unturned cone meet at a cylindrical collar positioned between the cones.

14. The container holder of claim 13 wherein the container is a long neck bottle and the cylindrical collar has a diameter sized to frictionally fit an opening of the long neck bottle when the long neck bottle is positioned on the container holder in an inverted orientation.

15. The container holder of claim 13 wherein the container is a long neck bottle and the collar defines an internal step having an upper surface that may be used to support the opening of the long neck bottle when the long neck bottle is positioned on the container holder in an inverted orientation.

16. The container holder of claim 13 wherein the container holder is reversible and the cone of the inverted cone differs in size from the cone of the unturned cone so that the container holder may be used in a first orientation to support bottles of a first type and may be used in a second orientation to support bottles of a second type different from the first type.

17. The container holder of claim 13 wherein the container is an oval shaped bottle and the recesses of the receptacle are recesses of the unturned cone for receiving shoulder portions of the oval shaped bottle when the oval bottle is positioned on the container holder in an inverted orientation.

18. The container holder of claim 17 wherein the recesses are defined in opposing sides of the unturned cone.

19. The container holder of claim 18 wherein the recesses comprise openings entirely through a side wall of the unturned cone.

20. The container holder of claim 19 wherein the openings entirely through the side walls of the unturned core comprise a first pair of openings through opposite sides of the side wall of the unturned cone and a second pair of openings through opposite sides of the side wall of the unturned cone, wherein the second pair of openings are rotated ninety degrees along the side wall from the first pair of openings so that axes extending between the respective opening pairs would intersect and be perpendicular to one another.

21. The container holder of claim 20 wherein the first pair of openings and second pair of openings have opening shapes that differ from one another so that the first pair of openings can accommodate containers different than the second pair of openings and vice versa.

22. A container holder comprising:

a base for supporting a receptacle; and a receptacle positioned atop the base for holding a container in an inverted orientation, the receptacle tapering from a larger opening on an end positioned opposite the base to a smaller opening on an end positioned proximate the base;

wherein the base and receptacle form a substantially dual cone structure with the base forming an inverted cone and the receptacle forming an unturned cone;

wherein the substantially dual cone structure is a substantially hyperboloid structure with an upward opening first portion defining the receptacle and unturned cone and a downward opening second portion defining the base and inverted cone; and wherein the first and second portions intersect with one another on respective first ends and terminate in respective upward and downward facing openings at distal ends thereof, and wherein the second portion is larger than the first portion and has four substantially triangular flanges extending from quadrants of the distal end defining the downward facing opening with each substantially triangular flange defining an opening and having a respective suction member disposed partially within each opening to allow the container holder to be suctioned to a surface to hold the container holder in place with respect to the surface.

* * * * *